US006734828B2

(12) United States Patent
Shor

(10) Patent No.: US 6,734,828 B2
(45) Date of Patent: May 11, 2004

(54) DUAL BAND PLANAR HIGH-FREQUENCY ANTENNA

(75) Inventor: Arie Shor, Sunnyvale, CA (US)

(73) Assignee: Atheros Communications, Inc., Sunnyvale, CA (US)

( * ) Notice: Subject to any disclaimer, the term of this patent is extended or adjusted under 35 U.S.C. 154(b) by 0 days.

(21) Appl. No.: 10/140,339

(22) Filed: May 6, 2002

(65) Prior Publication Data

US 2003/0020656 A1 Jan. 30, 2003

Related U.S. Application Data

(60) Provisional application No. 60/307,737, filed on Jul. 25, 2001.

(51) Int. Cl.[7] ..... H01Q 9/28

(52) U.S. Cl. ..... 343/795; 343/745; 343/749; 343/700 MS

(58) Field of Search ..... 343/700 MS, 722, 343/745, 749, 815, 818, 821, 795, 895

(56) References Cited

U.S. PATENT DOCUMENTS

| | | | | |
|---|---|---|---|---|
| 2,282,292 A | * | 5/1942 | Amy et al. | 343/722 |
| 2,655,599 A | * | 10/1953 | Finneburgh, Jr. | 343/801 |
| 3,887,925 A | * | 6/1975 | Ranghelli et al. | 343/795 |
| 4,438,437 A | | 3/1984 | Burgmyer | |
| 4,635,070 A | | 1/1987 | Hoover | |
| 5,532,708 A | | 7/1996 | Krenz et al. | |
| 5,708,446 A | | 1/1998 | Laramie | |
| 5,754,145 A | | 5/1998 | Evans | |
| 5,767,812 A | * | 6/1998 | Basciano et al. | 343/722 |
| 5,914,695 A | | 6/1999 | Liu et al. | |
| 5,977,928 A | | 11/1999 | Ying et al. | |
| 5,999,140 A | * | 12/1999 | Johnson | 343/795 |
| 6,014,112 A | | 1/2000 | Koscica et al. | |
| 6,037,911 A | | 3/2000 | Brankovic et al. | |
| 6,198,443 B1 | | 3/2001 | Powles et al. | |
| 6,204,826 B1 | | 3/2001 | Rutkowski et al. | |
| 6,218,990 B1 | | 4/2001 | Grangeat et al. | |
| 6,222,494 B1 | | 4/2001 | Erkocevic | |
| 6,326,921 B1 | | 12/2001 | Egorov et al. | |
| 6,337,666 B1 | | 1/2002 | Bishop | |
| 6,337,667 B1 | | 1/2002 | Ayala et al. | |
| 6,339,406 B1 | | 1/2002 | Nesic et al. | |
| 6,377,227 B1 | | 4/2002 | Zhu et al. | |
| 6,529,170 B1 | * | 3/2003 | Nishizawa et al. | 343/795 |

OTHER PUBLICATIONS

Copy of International Search Report dated Sep. 5, 2002 for PCT/US02/14479.

Copy of International Search Report dated Nov. 12, 2002 for PCT/US02/23678.

* cited by examiner

*Primary Examiner*—Tan Ho

(74) *Attorney, Agent, or Firm*—John W. Carpenter; Reed Smith LLP

(57) ABSTRACT

A dual mode, substantially planar antenna utilizes a dipole or monopole structure for receiving and transmitting high-frequency signals. Layers of conductive strips are disposed on opposite sides of an insulating (dielectric) substrate, such as printed circuit board material. First and second antenna elements are connected via an LC trap, the first antenna element corresponding to a first mode and the combined elements corresponding to a second mode. The LC trap is a single component inductor with parasitic capacitance sufficient to implement the LC trap or a set of patterns printed on the substrate. In one embodiment, the LC trap is constructed with only a single via through the substrate. The antenna is ideally suited for combined 5.5 GHz and 2.4 GHz RF operations.

40 Claims, 10 Drawing Sheets

DUAL BAND PLANAR HIGH-FREQUENCY ANTENNA

CROSS REFERENCE TO RELATED APPLICATIONS AND CLAIM OF PRIORITY

This invention claims priority to the following co-pending U.S. provisional patent application, which incorporated herein by reference, in its entirety:

Shor, et al., Provisional Application Serial No. 60/307,737, entitled "DUAL MODE PLANAR HIGH FREQUENCY ANTENNA," filed Jul. 25, 2001.

This present application is related to U.S. patent application Ser. No. 10/140,335, entitled "PLANAR HIGH-FREQUENCY ANTENNA", filed May 6, 2002; and is also related to U.S. patent application Ser. No. 10/140,336, entitled "PARALLEL-FEED PLANAR HIGH FREQUENCY ANTENNA", filed May 6, 2002; the disclosures of which are herein incorporated by reference.

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsover.

BACKGROUND OF THE INVENTION

1. Field of the Invention

The present invention relates generally to the field of high frequency antennas and more particularly to the field of dual mode, high-gain, planar, high-frequency antennas constructed using inexpensive manufacturing techniques.

2. Discussion of Background

The wireless communication industry's foremost objective is to provide antennas having (1) the lowest possible manufacturing costs with consistently uniform performance, (2) high gain, and (3) high directivity.

Conventional dipole antennas, in which each member of a pair of quarter wavelength radiators are fed in anti-phase, produce a substantially omni-directional radiation pattern in a plane normal to the axis of the radiators. However, providing such an omni-directional structure on a substantially planar and inexpensive surface, such as a printed circuit substrate, has proven a challenge. Existing attempts to achieve such planarity and performance rely on vias that penetrate the substrate to interconnect a plurality of conducting planes, thereby adding substantially to the cost of the antenna. Extending planar designs over a wide frequency range has proven even more difficult, since many designs only operate over a narrow frequency range.

Improving the gain of omnidirectional antennas is a common goal. Gain improvement is often achieved by designing an array of omnidirectional antennas, stacked on top of each other. Each antenna element must be spaced appropriately and fed with the right amplitude and phase (normally in-phase) to achieve a gain enhancement. Additional gain is realized by narrowing the beamwidth elevation, thereby focusing the same amount of energy into a narrower sector.

In existing designs, as the frequency changes, the phase difference between the two dipoles changes, as result of the feed lines having different lengths. For example, U.S. Pat. No. 6,037,911 discloses a phase array antenna in which the a "different phase feeding is applied" by "changing the length of the feeding lines approaching the printed dipoles from outside of the printed patch to the phase center (middle of the antenna)."

Other designs require the construction of vias through the substrate. U.S. Pat. No. 5,708,446 discloses an antenna that attempts to provide substantially omni-directional radiation pattern in a plane normal to the axis of the radiators. The patent discloses a corner reflector antenna array capable of being driven by a coaxial feed line. The antenna array comprises a right-angle corner reflector having first and second reflecting surfaces. A dielectric substrate is positioned adjacent the first reflective surface and contains a first and second opposing substrate surfaces and a plurality of dipole elements, each of the dipole elements including a first half dipole disposed on the first substrate surface and a second half dipole disposed on the second substrate surface. A twin line interconnection network, disposed on both the first and second substrate surfaces, provides a signal to the plurality of dipole elements. A printed circuit balun is used to connect the center and outer conductors of a coaxial feed line to the segments of the interconnection network disposed on the first and second substrate surfaces, respectively.

However, in order to connect the coaxial cable to the interconnection network, U.S. Pat. No. 5,708,446 requires a via to be constructed through the substrate. This via's penetration through the substrate requires additional manufacturing steps and, thus, adds substantially to the cost of the antenna.

Furthermore, other attempts require branched feed structures that further increase the number of manufacturing steps and thereby increase the cost of the antenna. A need exists to use fewer parts to assemble the feed so as to reduce labor costs. Present manufacturing processes rely on human skill in the assembly of the feed components. Hence, human error enters the assembly process and quality control must be used to ferret out and minimize such human error. This adds to the cost of the feed. Such human assembled feeds are also inconsistent in performance.

For example, U.S. Pat. No. 6,037,911 discloses a phase array antenna comprising a dielectric substrate, a plurality of dipole means each comprising a first and a second element, said first elements being printed on said front face and pointing in a first direction and said second elements being printed on said back face, and a metal strip means comprising a first line printed on said front face and coupled to said first element and a second line printed on said back face and coupled to said second element. A reflector means is also spaced to and parallel with said back face of said dielectric substrate and a low loss material is located between said reflector means and said back face, whereby said first and second lines respectively comprise a plurality of first and second line portions and said first and second line portions respectively being connected to each other by T-junctions.

However, in order to provide a balanced, omni-directional performance, U.S. Pat. No. 6,037,911 requires a branched feed structure through the utilization of T-junctions. These T-junctions add complexity to the design and, again, increase the cost of the antenna.

Finally, more complex, high frequency antennas have a high loss line structure and, thus, require an expensive dielectric substrate. Due to the simplicity of production and elements and the low cost of the raw materials, the antenna's cost is significantly lower than for more complicated, high frequency antennas.

Until now, dual mode (aka dual band) antennas have most often been implemented at lower frequencies. Some example dual mode antennas include U.S. Pat. No. 6,198,443, a cell phone dual mode antenna operable in 900 and 1800 MHz bands, U.S. Pat. No. 6,204,826, a dual band antenna disposed on a substrate, and U.S. Pat. No. 4,438,437, a dual mode blade antenna, and others. Some of the previous designs use lumped discrete elements to separate the received bands. At high frequencies, implementing this design (commonly known as a "trap") becomes difficult due to the deviation of the components from the ideal model, resulting in devices that are impractical to make with reasonable degrees of accuracy and repeatability. The proposed design offers a simple and inexpensive solution to this challenge.

SUMMARY OF THE INVENTION

To address the shortcomings of the prior art, the present invention provides several embodiments of a dual mode, substantially planar antenna utilizing monopole, dipole, and dipole array structures for receiving and transmitting high-frequency signals. Opposing layers of conductive strips are disposed on opposite sides of an insulating (dielectric) substrate, such as printed circuit board material.

In one embodiment, a planar two-sided dipole antenna design is extended to operate over two frequency bands by the addition of extra lengths of conductive strips connected to the main dipole elements by inductors. The length of the strips are determined based upon the desired resonant frequencies. At high frequencies, the parasitic capacitance of each inductor provides sufficient capacitance to form an LC notch/trap. This eliminates the need to form external capacitors on the substrate, reducing the cost of the antenna.

In another embodiment, a serial-fed planar high-frequency antenna has multi-dipole elements disposed on opposite sides of a substrate. Each dipole is bifurcated along a horizontal axis, with one half of a dipole disposed on one side of the substrate, and the other half disposed on the opposite side. Each dipole half is in electrical communication with a feed branch independent of the other half. A plurality of dipoles may be dispersed symmetrically along a main feed line. In order to operate over two frequency ranges, additional lengths of conductive strips are attached to each dipole elements via an inductor soldered between the main dipole element, and the extra length of conductive strip. The feed network preferably feeds the dipoles in-phase.

Similarly, a dual-mode parallel feed planar high frequency antenna may be constructed. Opposing layers of conductive strips are disposed on opposite sides of an insulating (dielectric) substrate. Each dipole is bifurcated along a horizontal axis, with one half of a dipole disposed on one side of the substrate and the other half disposed on the other side of the substrate. Each dipole half is in electrical communication with a feed branch independent of its other half. The feed branch on each side of the substrate feeds each dipole half with an equi-distant feed line from a common center point (i.e. feeds each dipole half "in parallel"). This provides for a wider operating range, since the dipoles are always fed with the same phase, even as the frequency changes. By connecting an extra conductive strip to each dipole element with an inductor, the antenna is operable over two different frequency ranges.

According to one embodiment of the present invention, the inductors are pre-fabricated inductors that are soldered between the main dipole elements and the extensions. In an alternative embodiment, the inductors may be formed directly on the substrate using a spiral structure. The spiral structure may be, for example, a square "Manhattan" spiral pattern or a circular spiral pattern. If additional capacitance is required, since a spiral structure inductor has lower parasitic capacitance, a discrete capacitor may be added by forming a plate on each side of the dielectric substrate.

Another type of dual mode antenna proposed is a dual-mode monopole. A monopole is one half of a dipole while the other half is replaced by a ground plane. The ground plane is needed for proper operation of the monopole. The dual mode monopole is fabricated in a fashion similar to that of the dipole—either with a series inductor between the two printed sections or with the printed trap comprising a spiral inductor and a parallel plate capacitor. The monopole may be implemented with either of two types of ground planes—either coplanar with or perpendicular to the monopole.

BRIEF DESCRIPTION OF THE DRAWINGS

The present invention will be readily understood by the following detailed description in conjunction with the accompanying drawings, wherein like reference numerals designate like structural elements, and in which.

It should be understood that the figures are intended only to illustrate the invention through example embodiments which are non limiting. Only any claims that issue henceforth and their equivalents should be used to limit the invention and the coverage provided by any issued patent.

DESCRIPTION OF THE PREFERRED EMBODIMENTS

The following description is provided to enable any person skilled in the art to make and use the invention and sets forth the best modes contemplated by the inventor for carrying out the invention. Various modifications, however, will remain readily apparent to those skilled in the art. Any and all such modifications, equivalents and alternatives are intended to fall within the spirit and scope of the present invention.

Figure 1:
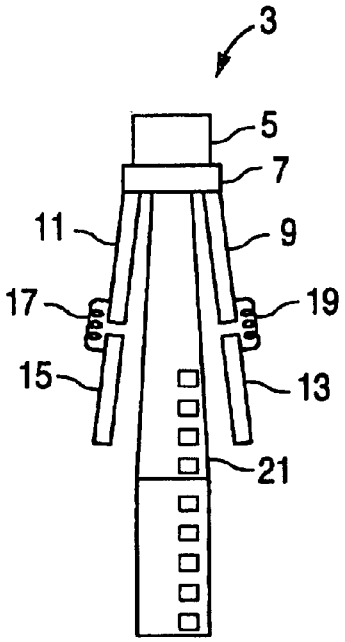
FIG. 1 illustrates a view of a first side a planar dipole configured according to the present invention.
Figure 2:
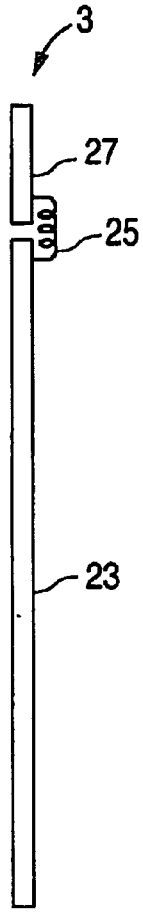
FIG. 2 illustrates a view of a second side of the planar dipole of FIG. 1.
Figure 3:
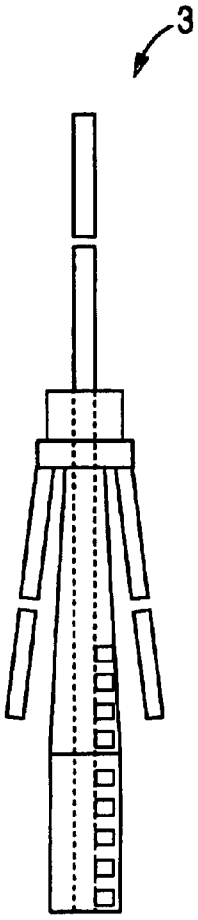
FIG. 3 is a combined view of the structure of FIGS. 1 and 2, shown without the substrate.

Referring now to FIGS. 1–3, a planar dipole antenna structure 3 incorporating the present invention is shown. In FIG. 1, a first side of the antenna 3 is illustrated. The antenna 3 is preferably formed of metallic conductive strips formed on opposite sides of a dielectric substrate (not shown). A feed structure 21 connects to a feed point 7, for feeding two dipole elements 9, 11. A matching element 5 is located above the feed point 7 which is not electrically connected, but has a capacitive coupling which affects the input impedance of the antenna in a manner that helps facilitate impedance matching. Additional conductive strips 13, 15 are attached to the dipole elements 9, 11 by inductors 17, 19, respectively.

FIG. 2 illustrates a view of the second side the planar dipole 3 design. A radiator element 23 is connected to a separate conductive strip 27 by an inductor 25. FIG. 3 illustrates a combined view of the structures shown in FIGS. 1 and 2.

For high-frequency operation, each inductor contains sufficient parasitic capacitance to form an LC matching network with the inductor for the extended conductive strip, thereby providing a "trap" for the additional dipole elements. This allows the antenna to operate independently over two different frequency ranges, based upon the lengths of the additional conductive strips and the values of the inductors. For example, this antenna may be constructed to operate over both the 2.4 GHz and 5.5 GHz bands. The 5.5 GHz band includes an operational range of 5.15–5.72 GHz, and the 2.4 GHz band includes an operational range of 2.4–2.5 GHz.

A 5.5 GHz dipole design is provided by dipole elements 9, 11, and radiator element 23. The 5.5 GHz design is modified by adding sufficient lengths (e.g. additional conductive strips 13, 15 and separate conductive strip 27) to the dipole elements to resonate at 2.4 GHz. Adding the sufficient lengths is done with only the additional inductors (inductors 7, 19, and 25), without any additional external capacitors. The preferred value of the inductors varies with the type of technology used to construct the inductor. In a preferred embodiment, a thick film inductor in the range of 5.6–6.8 nH is used. The parasitic capacitance may be, for example, about 0.12 pF.

FIG. 3 illustrates a combined view of the structures of FIGS. 1 and 2, without the substrate shown. Note that this view shows the structures "overlapping" but on opposite side of the substrate (not shown). For operation in the 2.4 GHz and 5.5 GHz frequency bands, preferred dimensions are shown in the figure. The extension 27 and radiator element 23 are 1.2 mm wide. The extension 27 is 8 mm long. The main dipole elements 9, 11 are 9.5 mm long, and the corresponding extensions 13, 15 are 7.8 mm long. The matching element is 5 mm wide and is 3.55 mm high and the distance from the top of the radiator 25 to the bottom of the matching element is 13.25 mm. The antennas may, for example, be directly connected to a co-axial cable, or have RF connectors fitted thereto.

Figure 4:
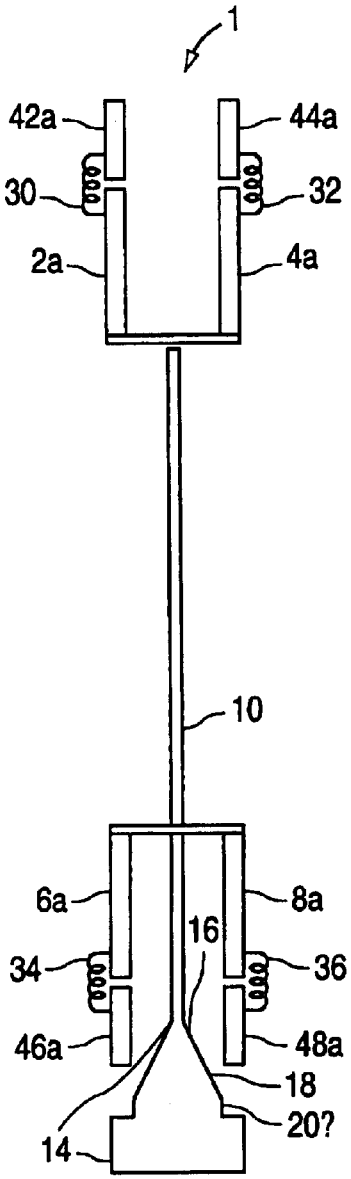
FIG. 4 illustrates a view of a first side of a serial-fed planar dipole antenna configured according to the present invention.
Figure 5:
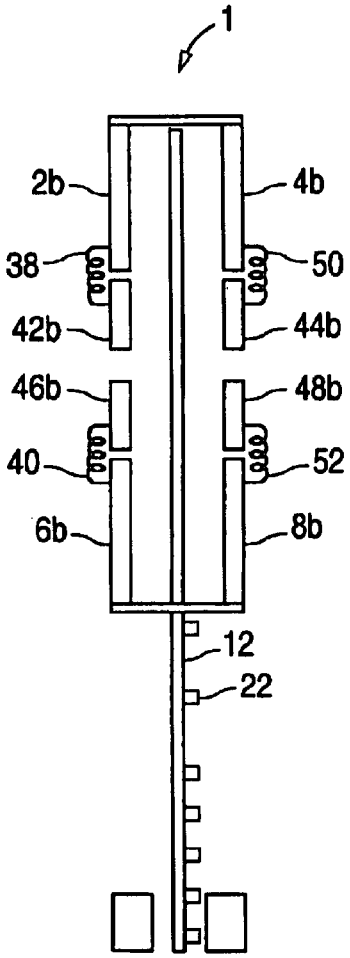
FIG. 5 illustrates a view of a second side of the serial-fed planar dipole antenna of FIG. 4.

As shown in FIGS. 4 and 5, there is illustrated a planar antenna 1 having a scalable, half-wavelength multi-dipole structure for receiving and transmitting high-frequency signals. Antenna 1 includes two layers of conducting (preferably metallic) strips disposed upon opposite sides of an insulating (dielectric) substrate (not shown). A plurality of half-wavelength dipoles 2, 4, 6, 8 are positioned along feed structures 10 and 12, such that 6 and 8 are in parallel, 2 and 4 are in parallel, and 6 and 8 are in series with 2 and 4. Each dipole is preferably bifurcated between the two sides of the substrate and each quarter-wavelength dipole half are separately connected to either of feed structures 10 and 12, respectively, as shown in FIGS. 4 and 5, thereby eliminating the need for additional substrate layers and vias to accommodate a singular feed structure. To ensure balanced, omnidirectional performance, the dipole portions are symmetrically positioned around the feed structures.

Balun structure 14, including tapered portions 16 and 18 and lower portion 20, provides the balanced performance characteristics required of feed structures 10 and 12 are preferably connected to two conductors in a coaxial configuration (not shown). In the illustrated example, feed structure 10 and balun structure 14 would be connected to an outer, grounded conductor, of a co-axial cable (or feed line) while structure 12 would be connected to an inner conductor. However, other cables, feed lines and connection arrangements may be utilized. Contact points (stubs) 22 are provided for fine-tuning I/O impedance, as necessary. One function of the balun is to transform an unbalanced load (such as a co-axial line or other connector) to a balanced load. Another function of the balun is to perform impedance transformation (e.g., 50 Ohms to a higher impedance).

As shown in FIG. 4, additional conductive strips 42*a*, 44*a*, 46*a*, 48*a* and 42*b*, 44*b*, 46*b*, 48*b* are added to the dipole elements 2*a*, 4*a*, 6*a*, 8*a* and 2*b*, 4*b*, 6*b*, 8*b*, respectively. Inductors 30, 32, 34, 36, 38, 40, 50, 52 are attached between the dipole elements 2*a*, 4*a*, 6*a*, 8*a*, 2*b*, 4*b*, 6*b*, 8*b* and the additional conductive strips 42*a*, 44*a*, 46*a*, 48*a*, 42*b*, 44*b*, 46*b*, 48*b*, respectively, in order to provide for dual-band operation.

Figure 6:
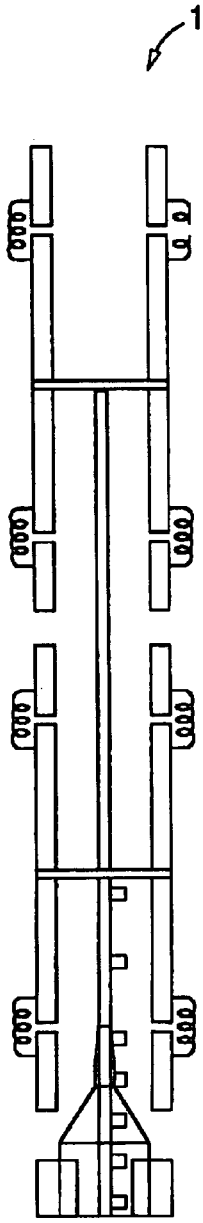
FIG. 6 is a combined view of the structure of FIGS. 4 and 5, shown without the substrate.

FIG. 6 shows a combined view of FIGS. 4 and 5 (with the substrate not shown for clarity). Note that the two sides of the substrate and symmetrically oriented in both the horizontal and vertical directions. For a preferred embodiment for operation in both the 2.4 GHz and 5.5 GHz bands, the dimensions are shown in FIG. 6. The dipole elements are 1.8 mm wide, and the feed lines are 1 mm wide. Each main dipole element is 13 mm long, and spaced 8.4 mm apart from the adjacent element. Each extension is 6.5 mm long, and spaced 0.5 mm away from the main dipole element. The total distance (vertically) between the two dipole arrays is 42.5 mm. Similar to the previously discussed embodiment, the inductors are in the range of 5.6–6.8 nH, depending on the type of technology used to fabricate the inductors. All these dimensions are typical for a substrate 0.5 mm thick with a dielectric constant of 3.4.

For high-frequency operation, each inductor contains sufficient parasitic capacitance to form an LC notch/trap with the inductor, thereby providing a "trap" for the additional dipole elements. This allows the antenna to operate over two different frequency ranges, based upon the lengths of the additional conductive strips and the values of the inductors. For example, this antenna may be constructed to operate over both the 2.4 GHz and 5.5 GHz bands, using only inductors, without any additional external capacitors. The preferred inductors are and, again, thick film inductors are in the range of 5.6–6.8 nH.

Figure 7:
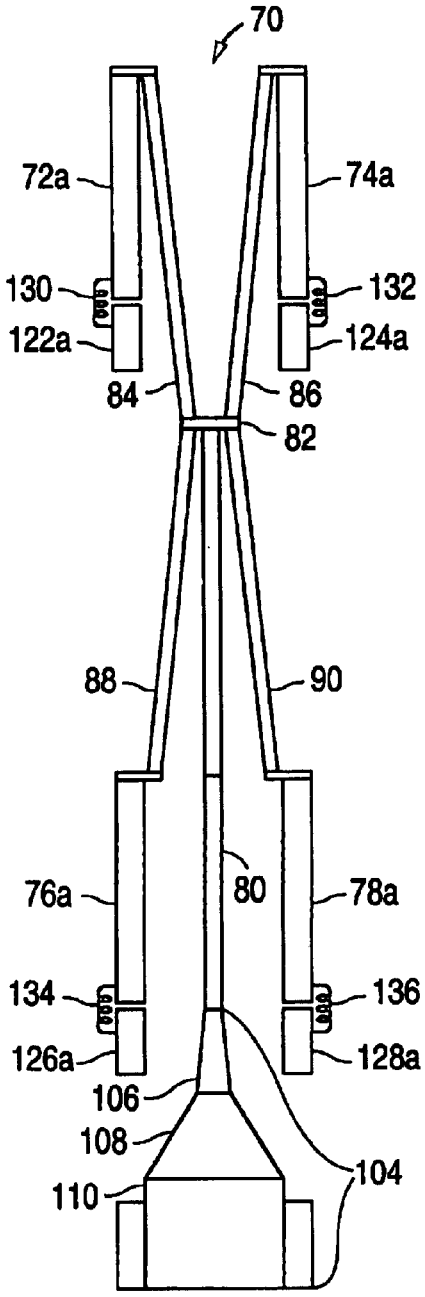
FIG. 7 illustrates a view of a first side of one embodiment of the present invention having a parallel feed line feeding two dipole halves.
Figure 8:
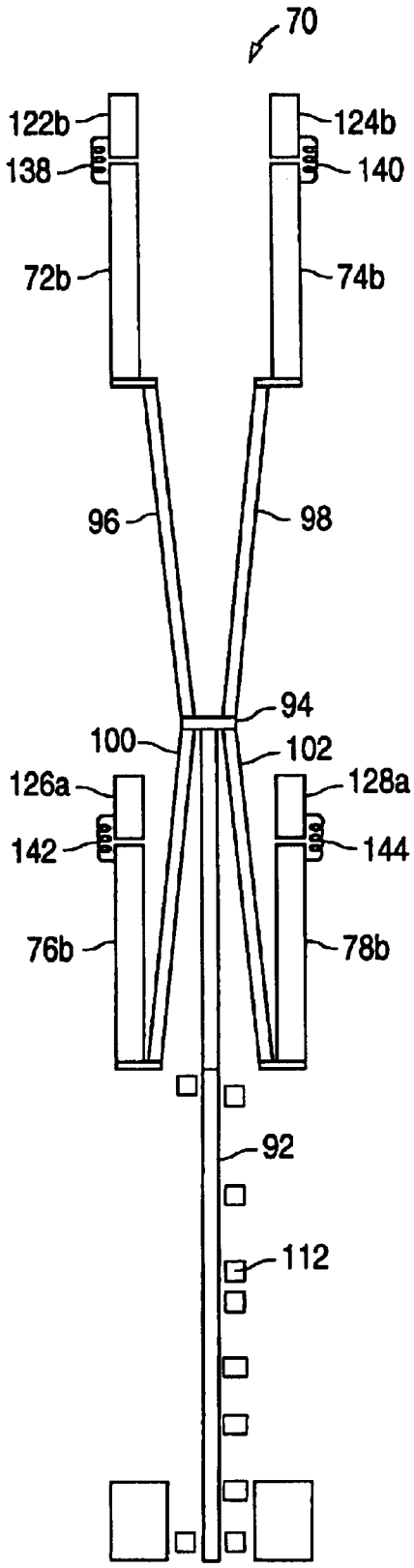
FIG. 8 illustrates a view of a second side of one embodiment of the present invention having a parallel feed line feeding two dipole halves.
Figure 9:
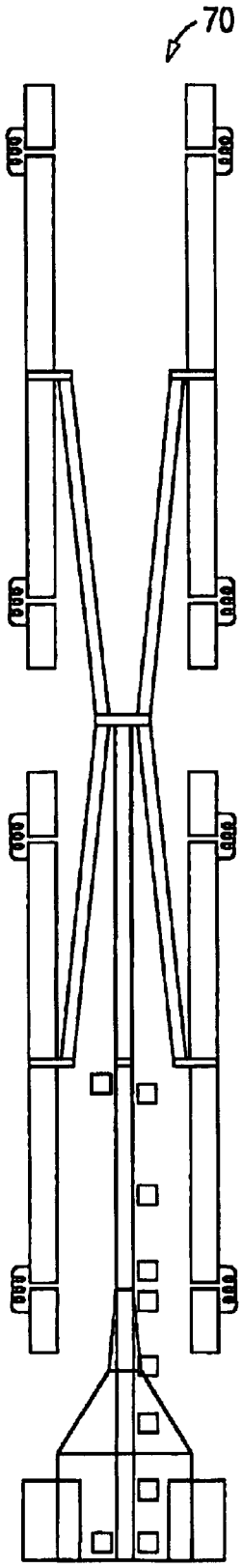
FIG. 9 illustrates a combined view of the structure of FIGS. 7 and 8, without the substrate.

An alternate embodiment of the present invention is shown in FIGS. 7–9. In FIG. 7, a planar antenna 70 includes two layers of conducting (preferably metallic) strips disposed upon opposing sides of an insulting substrate (not shown), serving as a dielectric layer. A plurality of half-wavelength dipole elements 72*a*, 74*a*, 76*a*, 78*a* are fed "in parallel," i.e. a feed structure 80 feeds a common feed point 82. The dipole elements are connected by equal length feed lines 84, 86, 88, 90 to the common feed point 82. The dipole elements 72*a*, 74*a*, 76*a*, 78*a* are connected to extensions 122*a*, 124*a*, 126*a*, 128*a* by inductors 130, 132, 134, 136, respectively.

A reverse side of the planar antenna 70 is illustrated in FIG. 8. A plurality of half-wavelength dipole elements 72*b*, 74*b*, 76*b*, 78*b* are similarly fed "in parallel' by a feed structure 92, which feeds a common feed point 94. The dipole elements are connected by equal length feed lines 96, 98, 100, 102 from the common feed point 94. The dipole elements 72*b*, 74*b*, 76*b*, 78*b* are connected to extensions 122*b*, 124*b*, 126*b*, 128*b* by the inductors 138, 140, 142, 144, respectively.

To ensure balanced, omni-directional performance, the dipoles are symmetrically positioned around the feed structures 80, 92. A balun structure 104, including tapered portions 106 and 108 are lower portion 110, provides the balanced performance characteristics required of the feed structures. The feed structures 80, 92 are preferably connected to two conductors in a coaxial configuration (not shown). In the illustrated example, the feed structure 80, including the balun structure 104, is connected to an outer grounded conductor, while the other feed structure 92 is connected to an inner conductor. The contract points 112 on the second side are provided for testing and for I/O impedance matching, as required.

The structures of FIGS. 7 and 8 are arranged symmetrically (horizontally and vertically) on the opposite sides of the substrate as shown in FIG. 9. FIG. 9 is a combined view of the antenna structure, shown without the substrate (for clarity). In this view, it is clear that the common feed points 82, 94 are symmetrically aligned, and that the dipole elements do not overlap (i.e. element 72*a* is below element 72*b*).

For a preferred embodiment operating in the 2.4 GHz and 5.5 GHz bands, the dimensions of the antenna elements are given in FIG. 9. The dipole elements are 1.8 mm wide, and are spaced 8.4 mm from an adjacent element. The main dipole elements are 13.8 mm long, and the extension elements are 6.5 mm long, and spaced 0.5 mm away from the main elements. The main feed lines are 1 mm wide, whereas the equal length feed lines are 0.8 mm wide. Each equal length feed line is 20.65 mm long, and the common feed point is 0.7 mm wide. The distance between the end of the feed lines (vertically) is 42.7 mm. The balun structures 106 and 108 are each 5 mm high. A suitable dimension for the substrate is 0.5 mm thickness.

As described herein, the parallel-feed embodiment can operate over a wider frequency range than other designs. In order to get signal elevation, the two dipoles must be fed in-phase (multiples of 360°). In other designs, as the frequency changes, the phase difference between the two dipoles changes, as a result of the feed structures having different lengths. In the parallel-feed design, however, since all the dipoles are fed with an equal length feed line, even as the frequency changes the dipoles are still fed with the same relative phase. This results in a operating range of approximately +/−6% of the nominal center frequency of the antenna, whereas previous designs were generally limited to operation over a range +/−2% of the nominal center frequency.

Additionally, because the antenna (e.g. 1, 3, 70) provides a low loss line structure, it is possible to use for the substrate (not shown) a dielectric of a standard quality, and thus of low cost, without considerably reducing the efficiency of the antenna. The substrate (not shown) is preferably between approximately 0.1 mm and 0.7 mm thickness to provide sufficient rigidity to support the antenna structure. Because of the simplicity of production and elements and the low cost of the raw materials, the cost of the antenna is considerably lower than for more complicated high frequency antennas. In one embodiment, the antenna is produced without the substrate, but increased costs are associated because the substrate embodiments are inexpensive to produce and more robust.

Figure 10A:
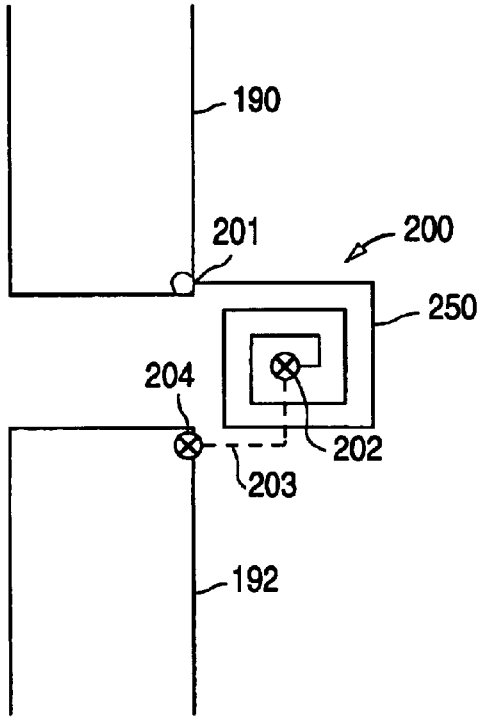
FIG. 10A illustrates an alternative Manhattan spiral structure inductor.

An alternate inductor configuration is shown in FIG. 10A, which may be used with any of the embodiments of the present invention. A "Manhattan spiral" structure may be used instead of a pre-fabricated inductor. An inductor 200 is constructed in a Manhattan spiral structure comprising a generally rectangular conductive trace 250, which may be directly applied to the substrate of the antenna. While a Manhattan spiral structure has been illustrated herein, the inductor may be formed in the shape of a spiral as well. By fabricating the inductor with the antenna on the substrate, inductor component and labor costs are reduced, as compared to an embodiment in which a pre-fabricated inductor is utilized. One end of the inductor 200 is directly connected (at 201) to one side of the dipole element 190. However, since one end of the inductor 200 is effectively in the center of the structure, a via 202 is provided in order to connect an end-point of the inductor to a trace 203 that also connects to one side of the dipole element 192. The conductive trace 203 is on an opposite side of the substrate, and a second via 204 is provided to connect this trace 203 to the dipole element 192.

Figure 10B:
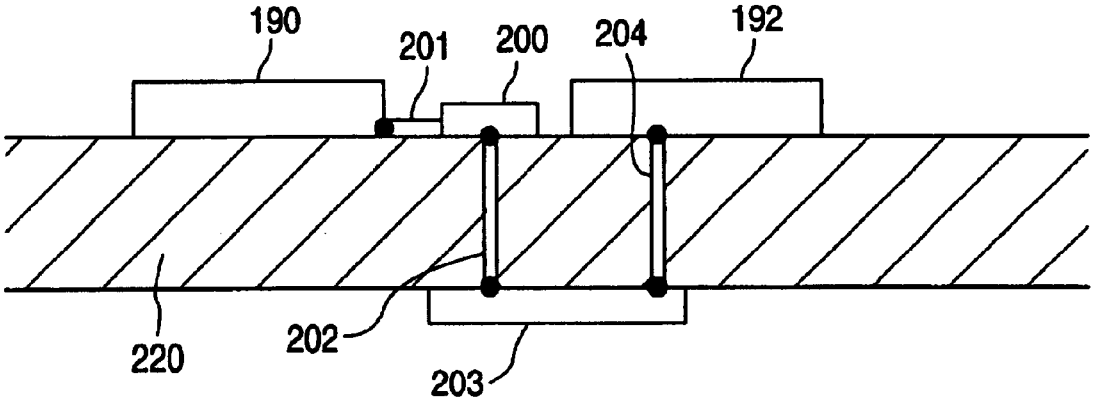
FIG. 10B is a side view of the Manhattan spiral structure inductor of FIG. 10A.

FIG. 10B is a side view of the Manhattan spiral structure inductor of FIG. 10A. Vias 202 and 204 are illustrated connecting the Manhattan spiral structure 200 and antenna element 192 to trace 203.

When using a Manhattan spiral structure, though, the parasitic capacitance may be insufficient to provide an appropriately tuned LC trap for some applications. In those cases, an additional capacitor may be provided. In one embodiment, the additional capacitor is a pre-fabricated component attached between dipoles 190 and 192. Other additional discrete or external capacitors may also be utilized.

Figure 11:
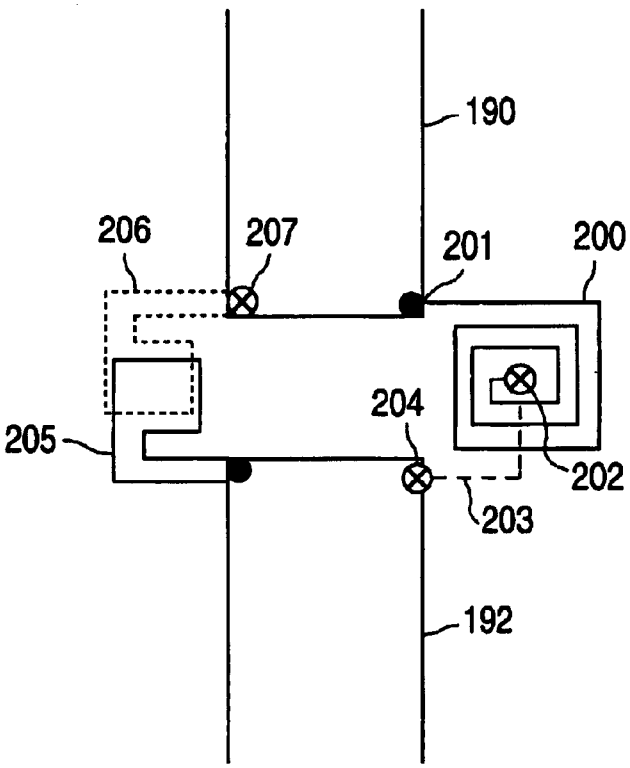
FIG. 11 illustrates a Manhattan spiral inductor formed with a capacitor.

Preferably, the additional capacitor is formed on the substrate as shown in FIG. 11. In this embodiment, the inductor is formed as described with reference to FIG. 10A. A first capacitive plate 205 is formed on the same side of the substrate as the inductor 200, and connected to one side of the dipole element 192. A second capacitive plate 206 is formed on the opposite side of the substrate (dielectric) (e.g., the first and second capacitive plates are disposed at locations substantially opposing each other, but on opposite sides of the substrate), and connected to a side of the dipole element 190 by a via 207 through the substrate. Thus, the LC trap is formed using three vias. However, other arrangements of vias, insulating layers, and connections may be utilized.

Figure 12B:
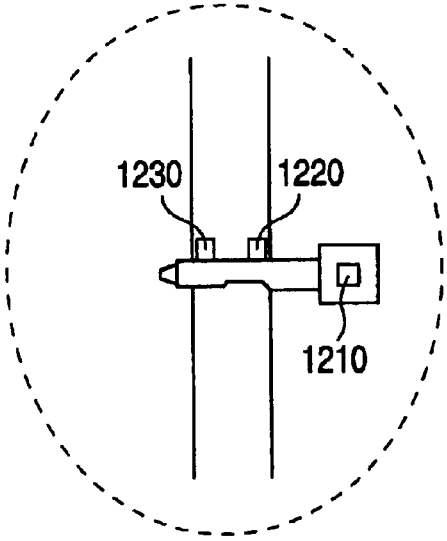
FIG. 12 illustrates the structure of FIG. 11 used in a serial-fed planar antenna design according to the present invention.
Figure 12:
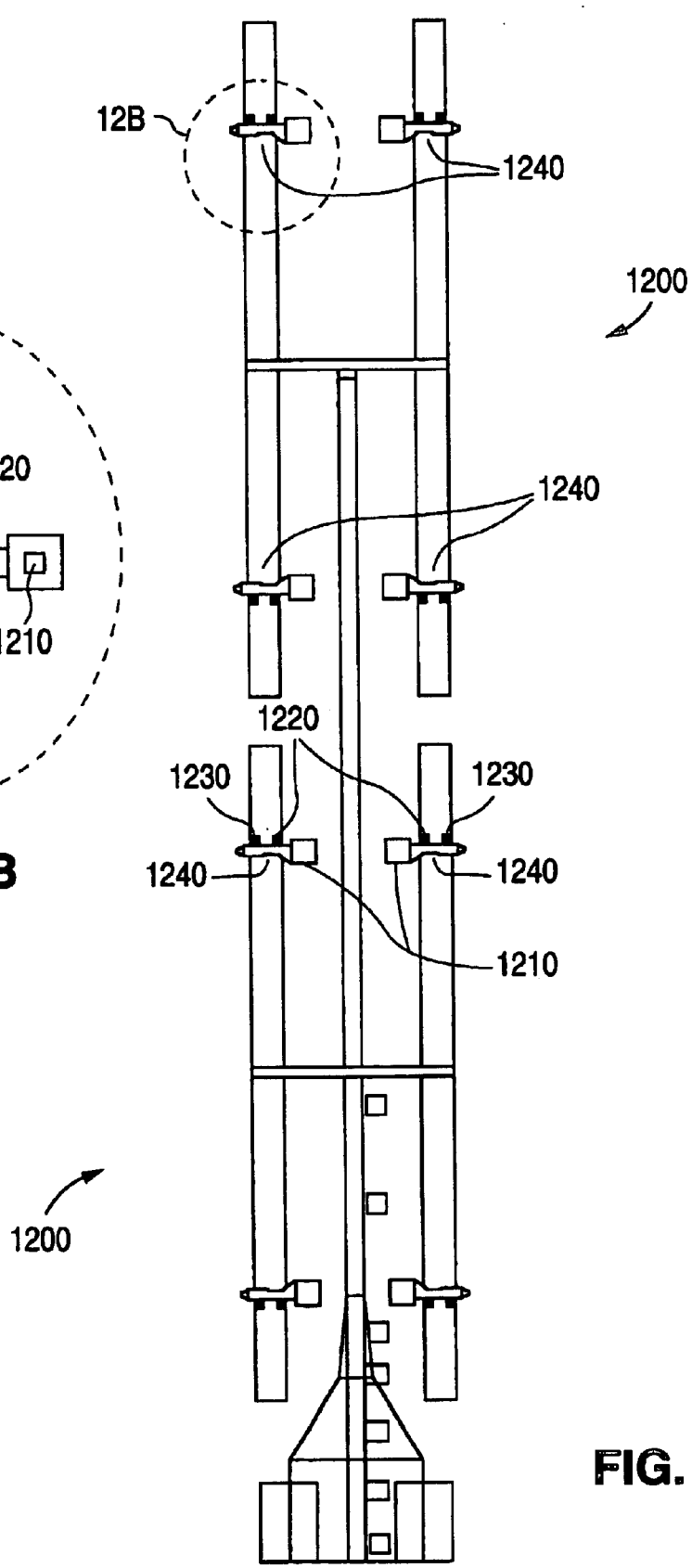

FIG. 12 illustrates the inductor and capacitor solution according to FIG. 11, as applied to a serial-feed planar design antenna 1200. Note that three vias 1210, 1220, 1230 are utilized for each LC trap 1240.

Figure 13:
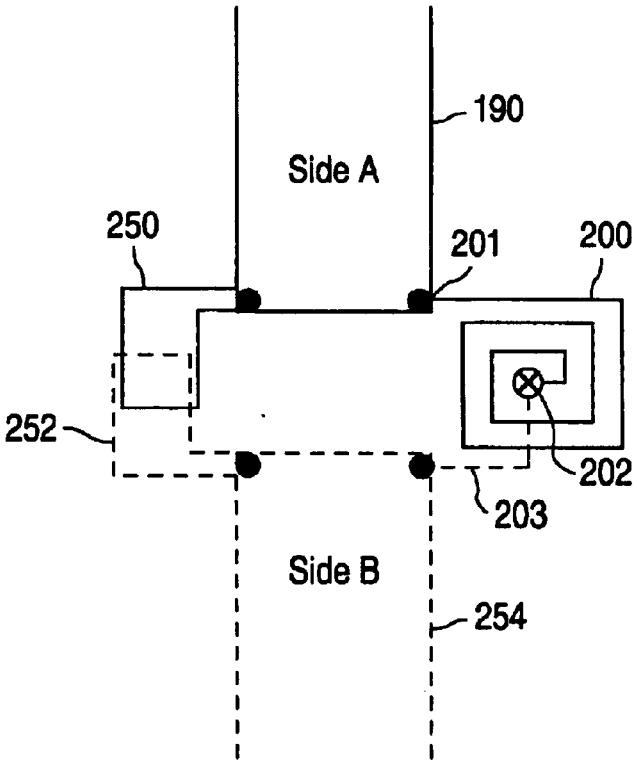
FIG. 13 illustrates an alternative construction of the Manhattan spiral inductor and the discrete, external capacitor.

In order to reduce the number of vias, the dipole element extensions (for dual band operation) may be formed on an opposite side of the substrate from the main dipole element. An example is shown in FIG. 13. In this embodiment, the inductor 200 is formed on one side of the substrate and on one end directly connects to the dipole element 190 on that side at point 201. A center connector of the inductor 200 is connected through via 202 to trace 203. Trace 203, on the opposite side of the substrate, connects to the other dipole element 254 on the opposite side of the substrate. A first capacitive element 250 is formed on the same side of the substrate as the inductor, and directly connects to the dipole element 190 on that side. Similarly, a second capacitive element 252 is formed on the opposite side of the substrate and directly connects to that dipole element 254. Thus, the capacitor and inductor combination can be formed using only a single via 202.

Figure 14:
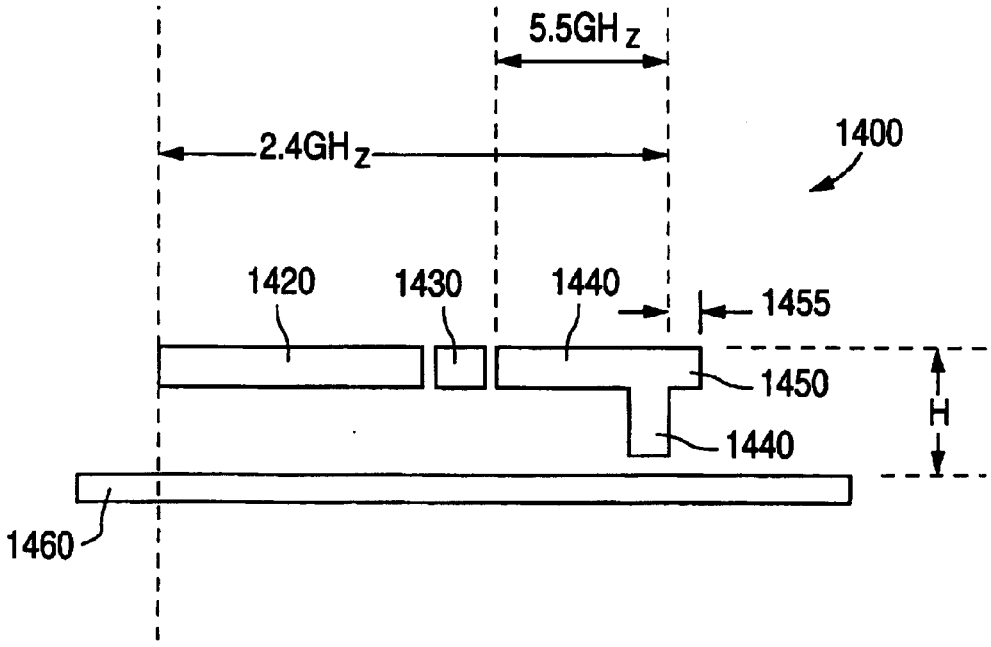
FIG. 14 is a drawing of a bent monopole antenna according to an embodiment of the present invention.

FIG. 14 is a drawing of a bent monopole (which may also be referred to as a one dimensional top loaded monopole) antenna 1400 according to an embodiment of the present invention. The bent monopole 1400 is constructed using a first frequency element 1440, an LC trap 1430, and a second frequency element 1420. Preferably, the first frequency element 1440 is a 5.5 GHz monopole, and the second frequency element 1420 is a 2.4 GHz extension element. The combined elements preferably have a length of up to 25 mm, the individual elements having a length equivalent a ¼ wavelength of their respective frequencies. The bent monopole antenna 1400 includes a back extension element 1450 which is used to tweak the 5 GHz band properties, and a base part 1440 that preferably lifts the frequency elements off of a ground plane 1460 by approximately 5–8 mm. The length of 1440, 1450, and 1455 depends on the Height (H). As H becomes longer, 1440, 1450, and 1455 become shorter.

The ground plane 1460 is generally provided by a printed circuit board that also contains RF circuitry that produces an RF signal that is to be broadcast by the bent monopole antenna 1400. Normally the ground plane is perpendicular to the plane of the monopole. The bent monopole antenna 1400 is connected to the circuitry via feed lines which preferably take the form of a co-axial cable. The bent monopole may be fed, for example, by a coaxial cable, microstrip conductor, or other feed line.

The bent monopole 1400 also includes LC trap 1430 which can be constructed from a single standard inductor component. The inductor component is selected for its parasitic capacitance. The inductance value and parasitic capacitance together form an LC trap having a resonance frequency such that only the higher frequency signals are broadcast by the first frequency element 1440 when applied to the antenna. Similarly, when the relatively lower frequency signals are applied to the antenna, the combination of the two antenna elements broadcast the lower frequency. The input impedance of the monopole is not necessarily 50 ohms. For short monopoles it is typically lower. An impedance transformer is printed on the GND for matching.

Figure 15:
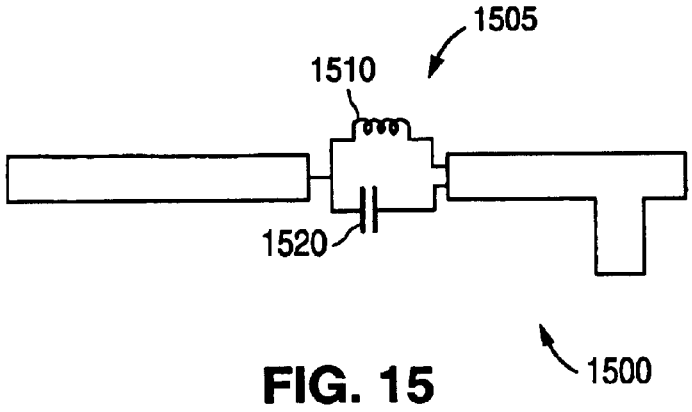
FIG. 15 is a schematic drawing illustrating electrical properties of a bent monopole antenna according to an embodiment of the present invention.

FIG. 15 is a schematic drawing illustrating electrical properties of a bent monopole antenna 1500 according to an embodiment of the present invention. The bent monopole antenna 1500 includes an LC trap 1505. The electrical properties of the LC trap 1505 include an inductor 1510 and capacitor 1520 in parallel. As noted above, in a single inductor component embodiment, both the capacitance and inductance are provided by a single inductor component.

Figure 16:
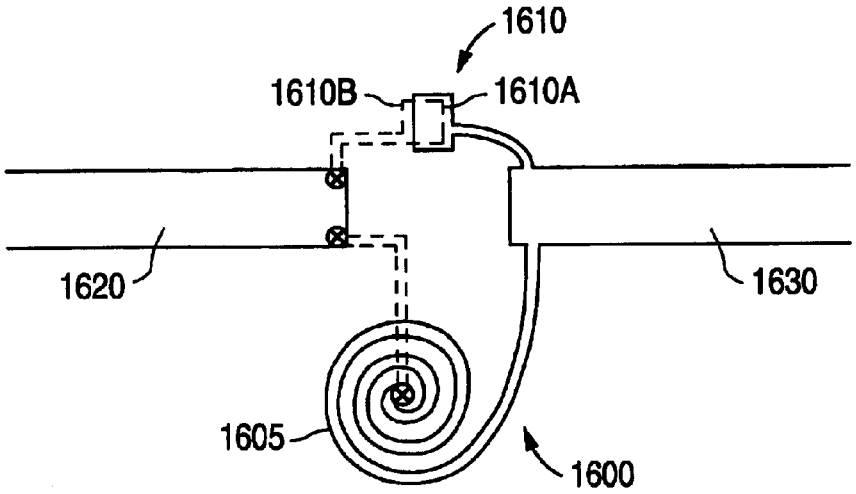
FIG. 16 is a drawing of an LC trap according to an embodiment of the present invention.

FIG. 16 is a drawing of an LC trap 1600 according to an embodiment of the present invention. In this embodiment, a printed inductor 1605 is utilized. The printed inductor 1605 is a spiral, which is generally a circular pattern of decreasing radius. The printed inductor has relatively little parasitic capacitance, so an additional capacitor is added to the LC trap. The additional capacitor (capacitor 1600) can be an additional off the shelf capacitive component, or, as illustrated in FIG. 16, the capacitor 1600 may be printed plates (1600A and 1600B) in opposition.

Figure 17:
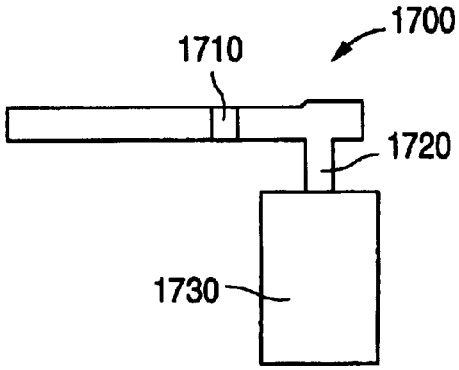
FIG. 17 is a drawing of a co-planar bent monopole antenna according to an embodiment of the present invention.

FIG. 17 is a drawing of a co-planar bent monopole antenna 1700 according to an embodiment of the present invention. A ground plane 1730 is provided. The ground plane 1730 is part of a circuit board containing the RF electronics configured to feed signals to the antenna 1700. The antenna 1700 is shown as an extension to the circuit board. The coplanar antenna 1700 includes first and second frequency elements separated by LC trap 1710. A base part 1720 connects the co-planar antenna 1700 to the ground plane 1730.

Selection of use of either the bent monopole antenna 1400 or the co-planar antenna 1700 will depend mainly on orientation of a device in which the antenna is installed. The bent monopole 1400 providing perpendicular dimensions and the coplanar antenna 1700 providing co-planar dimensions. The coplanar dimensions are advantageous in vertically oriented devices (such as a handheld computer, screen part of a notebook computer, etc) because the co-planar dimensions (directions) of the antenna allow for vertical polarization of signals emitted from the antenna. For similar reasons, horizontally oriented devices (e.g., notebook computer motherboard) are advantageously fitted with the bent monopole antenna 1400.

Figure 18A:
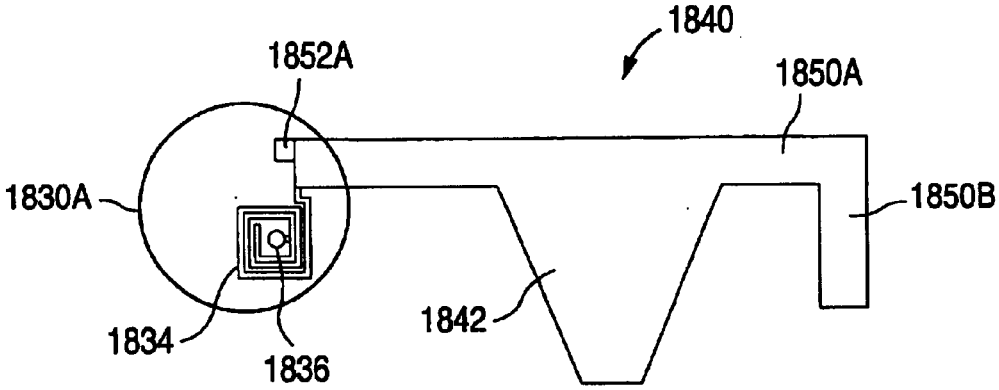
FIG. 18A is a drawing of a first layer of a bent monopole according to an embodiment of the present invention.

FIG. 18A is a drawing of a first layer of a bent monopole according to an embodiment of the present invention. A first frequency element 1840 has a non rectangular base area 1842 and back extension element 1850. The non rectangular base area 1842 has a bottom that is approximately 1.5 mm in width and tapers to approximately 5 mm in width. The back extension 1850 includes a parallel extension part 1850A and a perpendicular extension part 1850B. A first layer portion of an LC trap, 1830A, includes a capacitive plate 1832A, a Manhattan style inductor spiral 1834, and a plated via 1836 (common to layer 1 and layer 2). The Manhattan style inductor is printed on a substrate and has a width of approximately ⅛ mm width and ⅛ mm spacing between arms of the spiral. As with all the specific dimensions contained herein, based on the present disclosure, it should be understood that other dimensions may be substituted and not depart from the scope of the present invention. In addition, the inductor style may also be formed from a circular, oval, triangular, or other shaped spiral. The shape of the spiral may be chosen based on ease of implementing the spiral. For example, if a rectangular spiral is easier to draw on software or other tools used to implement the spiral, then a rectangular spiral may be used. In yet another alternative, the inductor may be formed from a meandering (no specific direction) traces or loops of any style that can either be freestanding or printed (disposed) on one or more layers of a substrate.

Figure 18B:
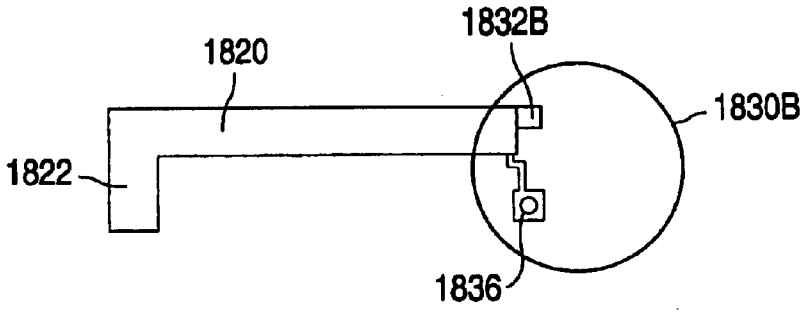
FIG. 18B is a drawing of a second layer of a bent monopole according to an embodiment of the present invention.

FIG. 18B is a drawing of a second layer of a bent monopole according to an embodiment of the present invention. A second frequency element 1820 also includes a back extension element 1822. Again, the back extension elements are used to tweak the exact frequency at which the elements most efficiently radiate RF signals. The back extension element 1822 is between 3 and 4 mm in height, but may vary further, particularly if different overall height of the antenna is used. For example, with an overall antenna height of 6 mm, the back extension element is 3–4 mm. However, with an overall antenna height of 8 mm, the back extension element can be shrunk to 0 mm. A second layer portion of an LC trap, 1830B, includes a second capacitive plate 1832B, and via 1836.

Figure 18C:
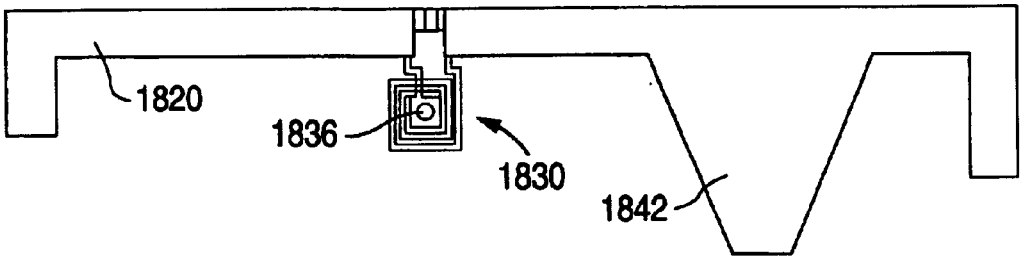
FIG. 18C is a composite drawing showing the first and second layers of the bent monopole in FIGS. 18A and 18B.

In this embodiment, the first layer is disposed on one layer of a substrate, and the second layer is disposed on a second layer of the substrate. the first and second layers are connected at via 1836. FIG. 18C is a composite drawing showing the first and second layers of the bent monopole in FIGS. 18A and 18B, connected at via 1836. Height of the bent monopole antenna are preferably either 6 mm or 7.5 mm. A width of the taller antenna is 17 mm, and 25 mm for the shorter one. Selection of antenna height and width can be based on packaging factors. Covers placed over the antennas will alter performance characteristics of the antenna.

Figure 19:
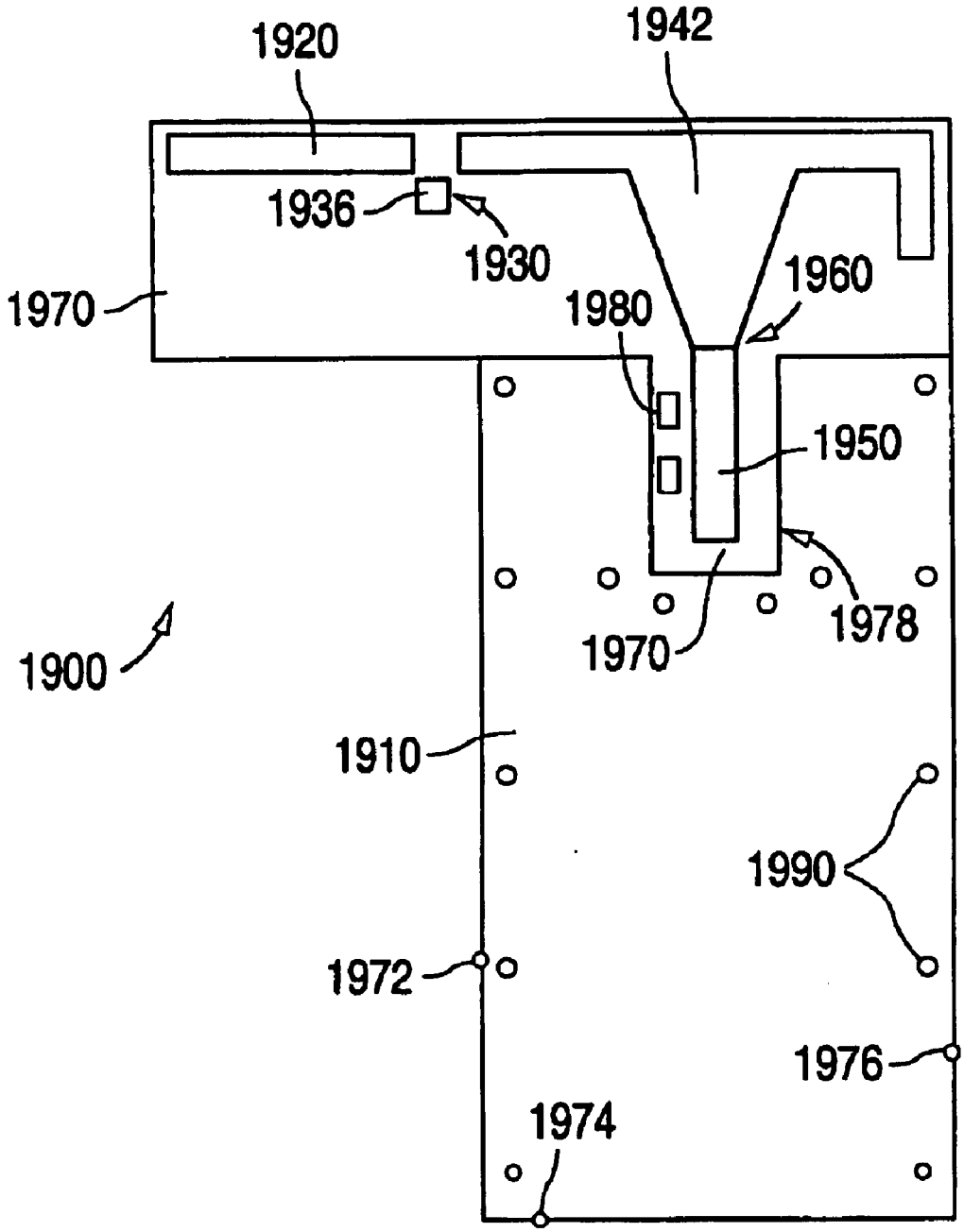
FIG. 19 is a drawing of a dual-band monopole antenna having a ground plane co-planar to a radiator according to an embodiment of the present invention.

FIG. 19 is a drawing of a dual-band monopole antenna 1900 having a ground plane 1910 co-planar to a radiator according to an embodiment of the present invention. Printed components 1920, 1930, 1936, and 1942 are constructed similar to corresponding parts in FIG. 18C. Trap 1930 is connected (e.g., via through hole 1936) to a second frequency element 1920. The ground plane 1910 has dimensions of approximately 15 mm×30 mm. A transmission line 1950, preferably up to 9 mm long is printed next to a feedpoint 1960 of the monopole. The transmission line is shown as a separate part connected to the non rectangular base area 1942 of the monopole, but preferably is continuously printed as a same discrete part (1942 and 1950 are combined as a single printed component) on the printed circuit board (PCB) 1970. Here, the PCB board is L-shaped, the monopole printed on the bottom part of the L, and the ground plane printed on the upper part of the L (the L is inverted and reversed in FIG. 19).

The transmission line 1950 is printed along a center line of the ground plane 1910. The ground plane 1910 is printed on both sides of the PCB 1970, and the two sides are connected. Preferably, the connection between the two sides of the ground plane is made by through hole plated vias 1990. Other connections may also be utilized alone or in combination with the through hole plated vias (e.g., continues printing of the ground plane on each of edges 1972, 1974, and 1976). A cut out section 1978 of the ground plane on the same side of the transmission line functions to separate the ground plane from the transmission line and one or more test points 1980.

The monopole configuration shown in FIG. 19 is best suited for situations where there is only a 2D space available for the antenna such as within the enclosure of a LCD monitor. The ground plane 1910 can be situated so that it is parallel to the LCD while only about 6 mm of the monopole extends beyond the LCD.

Of the various embodiments of the present invention, each may be affixed to a substrate, generally comprising a dielectric material as described above. In one embodiment, the substrate has a thickness of approximately 1 mm, and is constructed of 2 sided 0.5 mm FR4 board. Those skilled in the art will appreciate that various adaptations and modifications of the just-described preferred embodiments can be configured without departing from the scope and spirit of the invention. For example, it is clear that the invention is not limited to operation in the 2.4 or 5.5 GHz frequency bands, but may be adapted to operate with other signal frequencies. Dimensions of antenna elements and values of electrical components would then be modified, consistent with the teachings herein, to provide for proper operation at the other signal frequencies. Therefore, it is to be understood that, within the scope of the appended claims, the invention may be practiced other than as specifically described herein.

What is claimed and desired to be secured by Letters Patent of the United States is:

1. An antenna, comprising:

a substrate;

at least two dipole elements disposed on a first surface of the substrate;

a feed structure disposed on the first surface of the substrate and connected to said at least two dipole elements;

at least two additional conductive strips disposed on the first surface of the substrate, each additional conductive strip corresponding to a respective one of the dipole elements and coupled to the corresponding dipole element by an LC trap;

a radiator element disposed on a second surface of the substrate; and a separate conductive strip disposed on the second surface of the substrate and coupled to the radiator element by an LC trap.

2. The antenna according to claim 1, wherein the dipole elements and additional conductive strips are symmetrically arranged about the feed structure.

3. The antenna according to claim 1, wherein at least one of the LC traps comprise only an inductor, said inductor having a parasitic capacitance sufficient to create the LC trap.

4. The antenna according to claim 1, wherein each of the LC traps comprise only an inductor having a parasitic capacitance sufficient to create the LC trap.

5. The antenna according to claim 1, wherein said LC trap operates such that the feed structure and radiator element operate alone as an antenna when a signal at a first frequency is applied to the feed structure and radiator element, and the feed structure and radiator element operate in conjunction with the additional conductive strips and the separate conductive strip when a signal at a second frequency is applied.

6. The antenna according to claim 5, wherein the first frequency is 5.5 GHz and the second frequency is 2.4 GHz.

7. The antenna according to claim 1, wherein:

each LC trap comprises a spiral pattern, having an end point and a center point, printed on a side of the substrate;

in the case of a dipole element, the LC traps are connected at one of the end point and center point to the dipole element and connected at the other of the end point and center point to the corresponding conductive strip; and in the case of the radiator element, the LC trap is connected by one of the end point and center point to the radiator element and connected to the other of the end point and center point to the separate conductive strip.

8. The antenna according to claim 1, wherein at least one of the LC traps comprises a spiral pattern printed on a side of the substrate.

9. The antenna according to claim 8, wherein the spiral pattern is a Manhattan spiral pattern.

10. The antenna according to claim 8, wherein the spiral pattern is a decreasing radius circular pattern.

11. The antenna according to claim 8, wherein:

at least one of the dipole elements is disposed on a side of the substrate opposite to a side on which the dipole elements' corresponding additional conductive strips are disposed; and at least one of the LC traps between the dipole elements with corresponding conductive strips on opposite sides of the substrate include a single connection between the sides of the substrate.

12. The antenna according to claim 11, wherein each single connection of the LC traps comprises a via between the sides of the substrate.

13. The antenna according to claim 11, wherein each single connection for each dipole element/additional conductive strip element is constructed using via in the substrate.

14. An antenna device, comprising:

a substrate having an antenna disposed thereon, the antenna including, a first antenna element disposed on the substrate, a second antenna element disposed on the substrate, and an LC trap coupling the first antenna element and the second antenna element;

wherein:

the LC Trap comprises, a conductive strip disposed on a surface of the substrate in a spiral pattern, an end of the spiral pattern connected to one of the first and second antenna elements, and a center of the spiral pattern connected to the other of the first and second antenna elements, a first capacitive plate connected to the first antenna element and disposed on a side of the substrate, and a second capacitive plate connected to the second antenna element and disposed at a location substantially opposing the first conductive plate on a side of the substrate opposite the side which the first capacitive plate is disposed.

15. The antenna device according to claim 14, wherein the first and second antenna element are disposed on opposite sides of the substrate.

16. The antenna device according to claim 15, wherein the LC Trap is constructed using a single connection between the sides of the substrate.

17. The antenna device according to claim 16, wherein the single connection includes a via between the sides of the substrate.

18. The antenna according to claim 14, wherein the first and second antenna elements comprise an antenna element pair, and the antenna device includes more than one antenna element pairs.

19. The antenna according to claim 14, wherein the first and second antenna elements are dipole antenna elements.

20. The antenna device according to claim 14, wherein the first antenna element is a 5.5 GHz antenna element.

21. The antenna according to claim 14, wherein the second antenna element in combination with the first antenna element comprises a 2.4 GHz antenna element.

22. An antenna device, comprising:

a substrate having an antenna disposed thereon, the antenna including, a first frequency antenna element disposed on a first side of the substrate, a second frequency antenna element disposed on a second side of the substrate, and an LC trap coupling the first frequency antenna element and the second frequency antenna element;

wherein:

the LC Trap comprises conductive parts printed on the first and second sides of the substrate and including a single electrical connection between the first and second sides of the substrate.

23. The antenna device according to claim 22, wherein the conductive parts include a conductive strip disposed in a spiral pattern, an end of the spiral pattern connected to one of the first and second frequency antenna elements, and a center of the spiral pattern connected to the other of the first and second frequency antenna elements, a first capacitive plate connected to the first antenna element and disposed on a side of the substrate, and a second capacitive plate connected to the second antenna element and disposed at a location substantially opposing the first conductive plate on a side of the substrate opposite the side which the first capacitive plate is disposed.

24. An antenna device, comprising:

a substrate having an antenna disposed thereon, the antenna including, a first antenna element disposed on the substrate, a second antenna element disposed on the substrate, and an LC trap coupling the first antenna element and the second antenna element;

wherein:

the LC Trap comprises, an inductor component having an inductance and a capacitance sufficient to implement the LC trap such that the first antenna element radiates electrical energy efficiently at a first frequency and the first and second antenna elements radiate electrical energy efficiently at a second frequency;

the first antenna element, second antenna element, and LC trap comprise a first half dipole;

the antenna device further comprising multiple dipoles; and each dipole having first and second halves constructed similar to the first half dipole, and the antenna elements of the first half of each dipole half are disposed on opposite sides of the substrate compared to the antenna elements of the second half of the same dipole.

25. The antenna device according to claim 24, wherein the first frequency is the 5.5 GHz RE band and the second frequency is the 2.4 GHz RE band.

26. The antenna according to claim 25, wherein each LC trap comprises a single inductor having a parasitic capacitance sufficient to implement the LC trap.

27. The antenna device according to claim 24, further comprising:

a first feed line disposed on a first side of the substrate and coupled to dipole halves on the first side of the substrate;

a second feed line disposed on a second side of the substrate and coupled to dipole halves on the second side of the substrate;

wherein the dipoles are arranged in pairs symmetrically opposed around the feed lines.

28. The antenna device according to claim 27, wherein each set of dipole halves coupled to a same feed line and symmetrically opposed around the same feed line are iii situated in series with a second set of dipole halves also coupled to and symmetrically opposed around the same feed line.

29. The antenna device according to claim 28, wherein each set of dipole halves are connected through a feed point to the feed line to which they are coupled.

30. The antenna device according to claim 27, wherein each set of dipole halves coupled to a same feed line and symmetrically opposed around the same feed line are situated in parallel with a second set of dipole halves also coupled to and symmetrically opposed around the same feed line.

31. The antenna device according to claim 30, wherein each set of dipole halves are connected by equal length feed lines to a common feed point connected to the feed line to which they are coupled; and a second feed line disposed on a second side of the substrate.

32. The antenna according to claim 24, wherein each LC trap comprises only printed components.

33. An antenna, comprising:

a substrate;

at least two antenna elements disposed on the substrate, each antenna element comprising a first frequency sub-element coupled by an LC trap to a second frequency sub-element;

wherein:

each second frequency sub-element is disposed on a side of the substrate opposite to a side of the substrate on which the first frequency sub-element is disposed; and each LC trap is constructed using a single connection between the sides of the substrate.

34. The antenna element according to claim 33, wherein the single connection between the sides of the substrate is a via.

35. The antenna according to claim 33, wherein each LC trap comprises a single inductor having a parasitic capacitance sufficient to implement the LC trap.

36. The antenna according to claim 33, wherein each LC trap comprises only printed components.

37. The antenna according to claim 33, wherein the LC trap comprises only conductive strips disposed on the substrate.

38. An antenna device, comprising:

a substrate having an antenna disposed thereon, the antenna including, a first antenna element disposed on the substrate, a second antenna element disposed on the substrate, and an LC trap coupling the first antenna element and the second antenna element;

wherein:

the LC Trap comprises, inductor component comprising an inductance and capacitance sufficient to form the LC trap such that the first antenna element radiates electrical energy efficiently at a first frequency and the first and second antenna elements radiate electrical energy efficiently at a second frequency.

39. The antenna according to claim 38, wherein the first antenna element comprises a 5 GHz band antenna, and the LC Trap is operative in the 5 GHz band.

40. The antenna according to claim 39, wherein the LC trap comprises only printed components.

* * * * *